US008313692B2

(12) United States Patent
Somekawa et al.

(10) Patent No.: US 8,313,692 B2
(45) Date of Patent: Nov. 20, 2012

(54) MG-BASED ALLOY

(75) Inventors: Hidetoshi Somekawa, Ibaraki (JP); Alok Singh, Ibaraki (JP); Yoshiaki Osawa, Ibaraki (JP); Toshiji Mukai, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 223 days.

(21) Appl. No.: 12/995,522

(22) PCT Filed: Jun. 3, 2009

(86) PCT No.: PCT/JP2009/060188

§ 371 (c)(1), (2), (4) Date: Dec. 1, 2010

(87) PCT Pub. No.: WO2009/148093

PCT Pub. Date: Dec. 10, 2009

(65) Prior Publication Data

US 2011/0076178 A1 Mar. 31, 2011

(30) Foreign Application Priority Data

Jun. 3, 2008 (JP) ..... 2008-145520
Mar. 23, 2009 (JP) ..... 2009-069660

(51) Int. Cl.
*C22C 23/02* (2006.01)

(52) U.S. Cl. ..... 420/408

(58) Field of Classification Search ..... 420/408
See application file for complete search history.

(56) References Cited

FOREIGN PATENT DOCUMENTS

| | | |
|---|---|---|
| EP | 0 548 875 | 6/1993 |
| JP | 5-171330 | 7/1993 |
| JP | 5-311310 | 11/1993 |
| JP | 2007-113037 | 5/2007 |

OTHER PUBLICATIONS

International Search Report issued Sep. 8, 2009 in International (PCT) Application No. PCT/JP2009/060188.

*Primary Examiner* — Jessee R. Roe
(74) *Attorney, Agent, or Firm* — Wenderoth, Lind & Ponack, L.L.P.

(57) ABSTRACT

An Mg-base alloy shows that an Mg-base alloy, which is added Zn and Al to magnesium, has a composition represented by (100-a-b) wt % Mg-a wt % Al-b wt % Zn, and satisfying $0.5 \leqq b/a$. The alloy can reduce yield anisotropy, which is a serious problem for the wrought magnesium alloy, while maintaining a high strength property. The alloy is produced by additive elements, such as Zn and Al, which are easily obtained in place of rare earth elements.

8 Claims, 13 Drawing Sheets

MG-BASED ALLOY

This application is a U.S. national stage of International Application No. PCT/JP2009/060188 filed Jun. 3, 2009.

TECHNICAL FIELD

The present invention relates to an Mg-based alloy of which the yield anisotropy has been reduced.

BACKGROUND ART

Magnesium is a lightweight and provides rich resources, and thus, magnesium is specifically noted as a material for weight reduction for electronic devices, structural members, etc.

On the other hand, in order to apply to the structural parts, i.e., rail ways and auto mobiles, the alloy needs to show the high strength, ductility and toughness, from the viewpoints of safety and reliability for the human been.

FIG. 1 shows a relationship between the strength and the elongation-to-failure of wrought magnesium alloys and cast magnesium alloys; and FIG. 2 shows a relationship between the specific strength (=yield stress/density) and the fracture toughness. It is known that wrought alloys show higher ductility and toughness than those of the casted alloys. Therefore, the wrought process, i.e., strain working, is found to be one of the effective methods to obtain excellent characteristics of strength, ductility and toughness.

However, when magnesium alloys are produced by wrought process through rolling, extrusion, there is a problem that the alloy has a strong texture due to the process. Therefore, a conventional wrought magnesium alloy could have a high tensile strength at room temperature; however this alloy shows a low compression strength. Accordingly, when a conventional wrought magnesium alloy is applied to mobile structural parts, there is a large defect; the part, which is applied the compressive strain, occurs brittle fracture and the lacks of isotropic deformation.

Recently, it has been found that the formation of a specific phase, i.e., quasi-crystal phase, which possesses five-fold symmetry and is very different from crystalline phases, has discovered in an Mg—Zn-RE alloy (where RE=Y, Gd, Dy, Ho, Er, Tb).

The quasi-crystal phase has a good matching to a magnesium matrix interface, i.e., the interface between magnesium and quasi-crystal phase is coherency. Therefore, the dispersion of a quasi-crystal phase in a magnesium matrix causes to the reduction of the basal texture and can enhance the compression strength with high tensile strength. In addition, this alloy can reduce the yield anisotropy, which is an unfavorable characteristic to apply the structural parts.

However, in order to form a quasi-crystal phase in a magnesium alloy, there is a serious problem that the addition of a rare earth element is indispensable. The rare earth element is an element that is rare and valuable. Therefore, if the alloy with the addition of rare earth elements could exhibit good properties, its material cost is expensive; not advantage from the industrial point of views.

Concretely, Patent References 1 to 3 merely specify that, the addition of a rare earth element (especially yttrium) is necessary to form the quasi-crystal phase in magnesium.

Patent Reference 4 merely shows that, the addition of yttrium and other rare earth element is indispensable to form the quasi-crystal phase in magnesium. The problem that the wrought magnesium alloy shows the yield anisotropy, could be solved due to the dispersion of quasi-crystal phase and the grain refinement.

Patent Reference 5 merely specifies that the addition of yttrium and other rare earth element is indispensable to form the quasi-crystal phase in magnesium. This reference shows the working conditions (working temperature, speed, etc.) at the secondary forming using the magnesium alloys with dispersion of quasi-crystal phase.

Non-Patent References 1 and 2 describe the formation of a quasi-crystal phase of Mg—Zn—Al alloy. However, since the phase is a quasi-crystal single phase, an Mg matrix does not exist in this alloy.

In Non-Patent Reference 3, the size of the Mg matrix is at least 50 μm since the alloys are produced by a casting method. Therefore, this reference does not show that the alloy exhibit high strength/high toughness properties on the same level as or higher than that of the above-mentioned, rare earth element-added (Mg—Zn-RE) alloys. In addition, it would involve technical difficulties (see FIGS. 1 and 2).

Patent Reference 1: JP-A 2002-309332

Patent Reference 2: JP-A 2005-113234

Patent Reference 3: JP-A 2005-113235

Patent Reference 4: Japanese Patent Application No. 2006-211523

Patent Reference 5: Japanese Patent Application No. 2007-238620

Non-Patent Reference 1: G. Bergman, J. Waugh, L. Pauling: Acta Cryst. (1957) 10 254

Non-Patent Reference 2: T. Rajasekharan, D. Akhtar, R. Gopalan, K. Muraleedharan: *Nature* (1986) 322 528

Non-Patent Reference 3: L. Bourgeois, C. L. Mendis, B. C. Muddle, J. F. Nie: *Philo. Mag. Lett.* (2001) 81 709

DISCLOSURE OF THE INVENTION

Problems that the Invention is to Solve

The present invention has been made in consideration of the above-mentioned situation, and its object is to make it possible to reduce the yield anisotropy, which is a serious problem of the wrought magnesium alloys, by using additive elements which are easily obtained in place of a rare earth element while maintaining a high tensile strength.

Means for Solving the Problems

For solving the above-mentioned problems, the present invention is characterized by the following:

The Mg-base alloy of the invention is an Mg-base alloy containing Zn and Al added to magnesium, comprising a composition represented by (100-a-b) wt % Mg-a wt % Al-b wt % Zn and satisfying 0.5 b/a.

In the Mg-base alloy, $5 \leqq b \leqq 55$ and $2 \leqq a \leqq 18$ are preferable.

In the Mg-base alloy, a quasi-crystal phase or its approximate crystal phase is preferably dispersed in the magnesium matrix.

In the Mg-base alloy, the size of the Mg matrix is preferably at most 40 μm.

Effects of the Invention

According to the invention, uses of Zn and Al elements in place of a rare earth element expresses that the alloy with using of Zn and Al elements can reduce the yield anisotropy to the same level as or to a higher level than that in the alloy with a rare earth element.

BEST MODE FOR CARRYING OUT THE INVENTION

Figure 1:
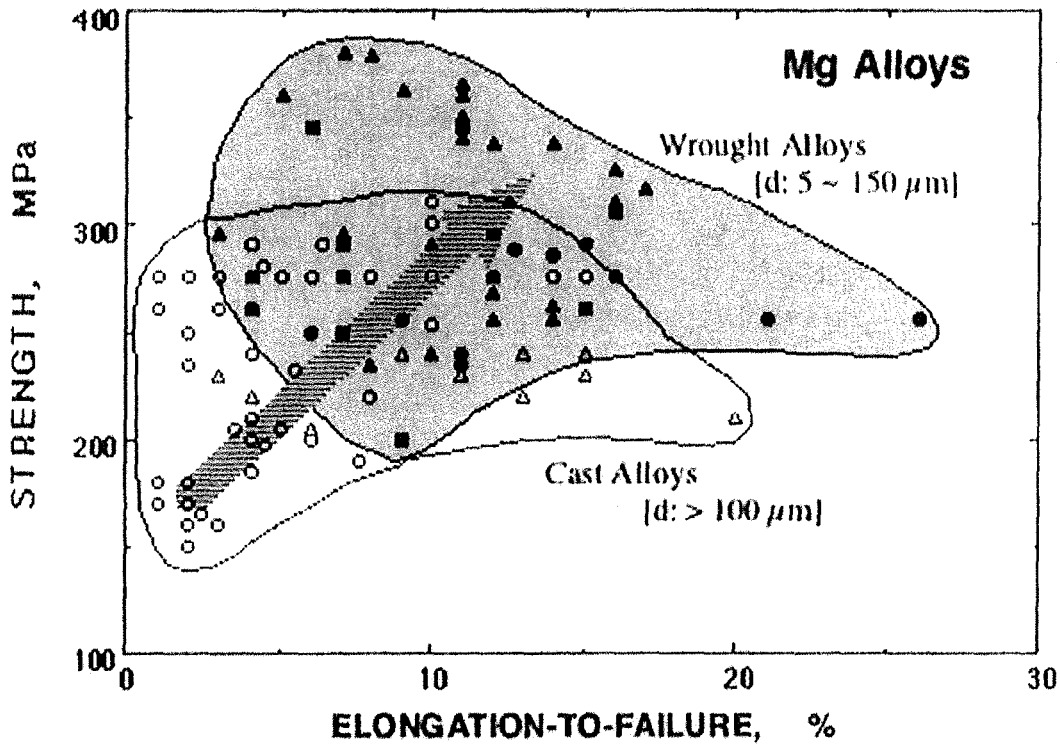
FIG. 1 shows a relationship between the strength and the elongation-to-failure of wrought magnesium alloys and cast magnesium alloys.
Figure 2:
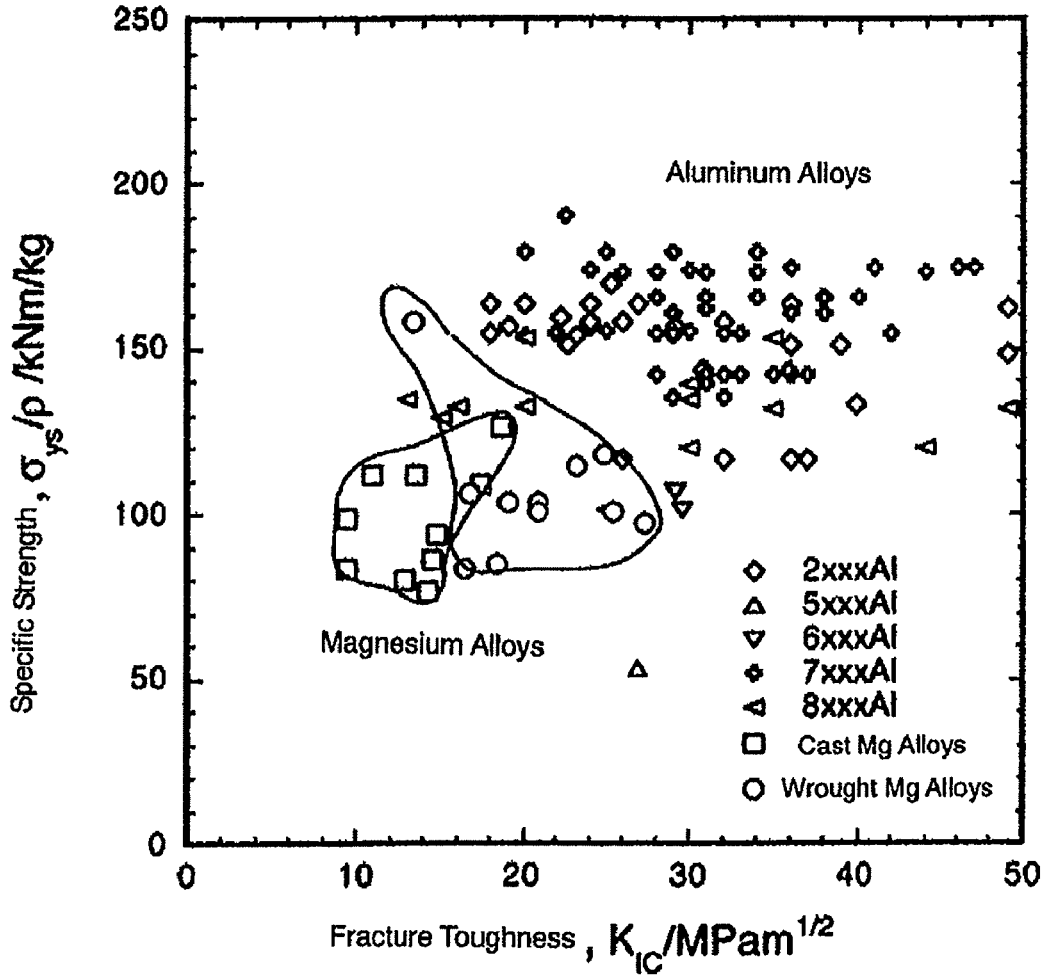
FIG. 2 shows a relationship between the specific strength (=yield stress/density) and the fracture toughness of wrought magnesium alloys and cast magnesium alloys.

The invention will be described in detail.

When the composition of the present invention represented by (100-a-b) wt % Mg-a wt % Al-b wt % Zn satisfies $0.5 \leqq b/a$, the results, which describe in below, show that the yield anisotropy could reduce. In the present invention, preferably, $1 \leqq b/a$, more preferably $1.5 \leqq b/a$.

When $5 \leqq b \leqq 55$ and $2 \leqq a \leqq 18$, a quasi-crystal phase and/or the close to the structure of the quasi-crystal phase is formed in magnesium.

More preferably, $2 \leqq b/a \leqq 10$, and when $6 \leqq b \leqq 20$ and $2 \leqq a \leqq 10$, a quasi-crystal phase and/or the close to the structure of the quasi-crystal phase is formed in magnesium.

In order to reduce the yield anisotropy, i.e., showing the ratio of compression tensile yield stress of 0.8, the size of the magnesium matrix is preferably at most 40 μm, more preferably at most 20 μm, even more preferably at most 10 μm. The volume fraction of the quasi-crystal phase or the close to the structure of quasi-crystal phase is preferably from 1% to 40%, more preferably from 2% to 30%. The size of the quasi-crystal phase particles and the close to the structure of quasi-crystal phase particles is preferably at most 5 μm, more preferably at most 1 μm, and its limit is preferably at least 50 nm.

In order to obtain the above-mentioned microstructures and mechanical properties, the applied strain is at least 1, and the temperature is from 200° C. to 400° C. (at intervals of 50° C.—the same shall use hereafter).

In general, in order to reduce the fraction of dendrite structures, the alloys with the addition of rare earth elements have homogenized at a temperature of at most 460° C. for at least 4 hours before the extrusion or severe plastic deformation. However, in the present invention, uniform dispersion of the quasi-crystal phase could be attained without the heat treatment before the extrusion or severe plastic deformation.

The formation of the Quasi-crystal phase and the close to the structure of quasi-crystal phase is greatly influenced by the cooling speed during solidification. In the case of the present alloy, the quasi-crystal phase and the phase close to the structure of the quasi-crystal phase are possible to form even at the cooling rate. Therefore, the casted alloy is possible to be produced by not only the conventional casting process with a low cooling rate, but also die casting or rapid solidification with a high cooling rate.

EXAMPLES

The invention will be described in more detail with reference to the following Examples. However, the invention is not limited at all by the Examples.

Example 1

Pure magnesium (purity, 99.95%), 8 wt. % zinc and 4 wt. % aluminium (hereinafter this is referred to as Mg—8 wt. % Zn—4 wt. % Al) were melted to produce a casted alloy. The casted alloy was machined to prepare an extrusion billet having a diameter of 40 mm. The extrusion billet was put into an extrusion container heated up to 300° C., kept therein for ½ hours, and then hot-extruded at an extrusion ratio of 25/1 to produce an extruded alloy having a diameter of 8 mm.

The microstructural observation and X-ray analysis were carried out in the extruded alloy. The observed position was the parallel to the extrusion direction. Also, the microstructural observation by a transmission electronic microscope (TEM) and X-ray analysis were carried out in the casted alloy.

Figure 3:
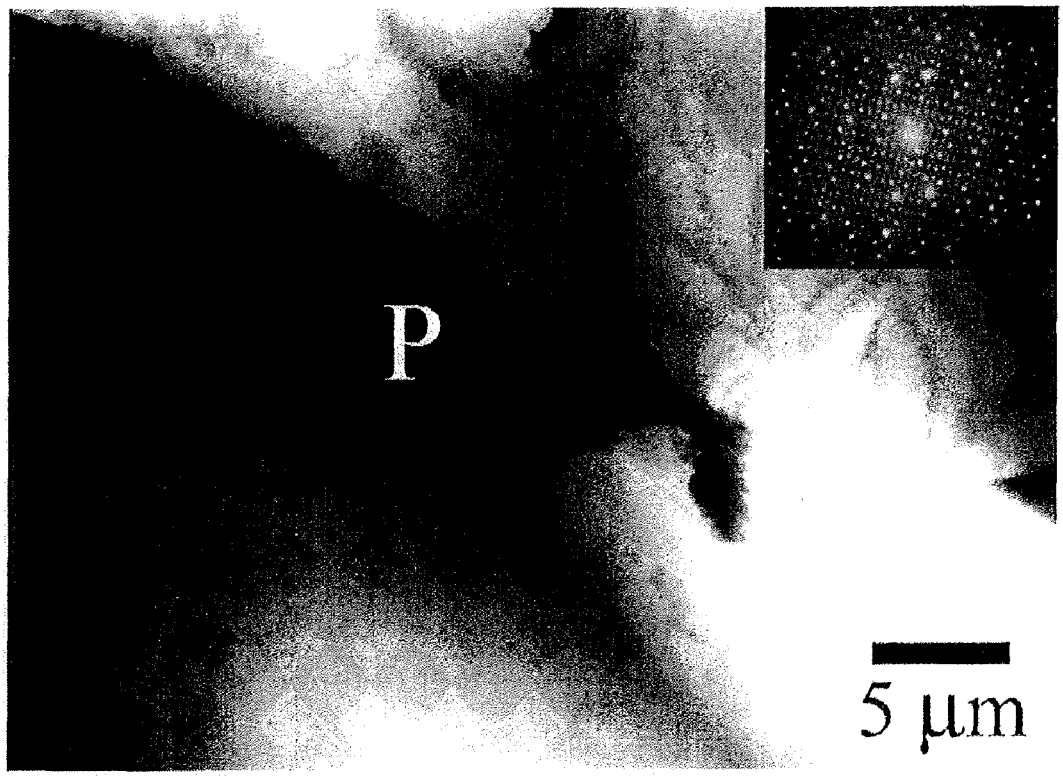
FIG. 3 is a photograph showing the result of microstructural observation in Example 1, and shows the microstructure of the casted alloy by a transmission electronic microscope.
Figure 4:
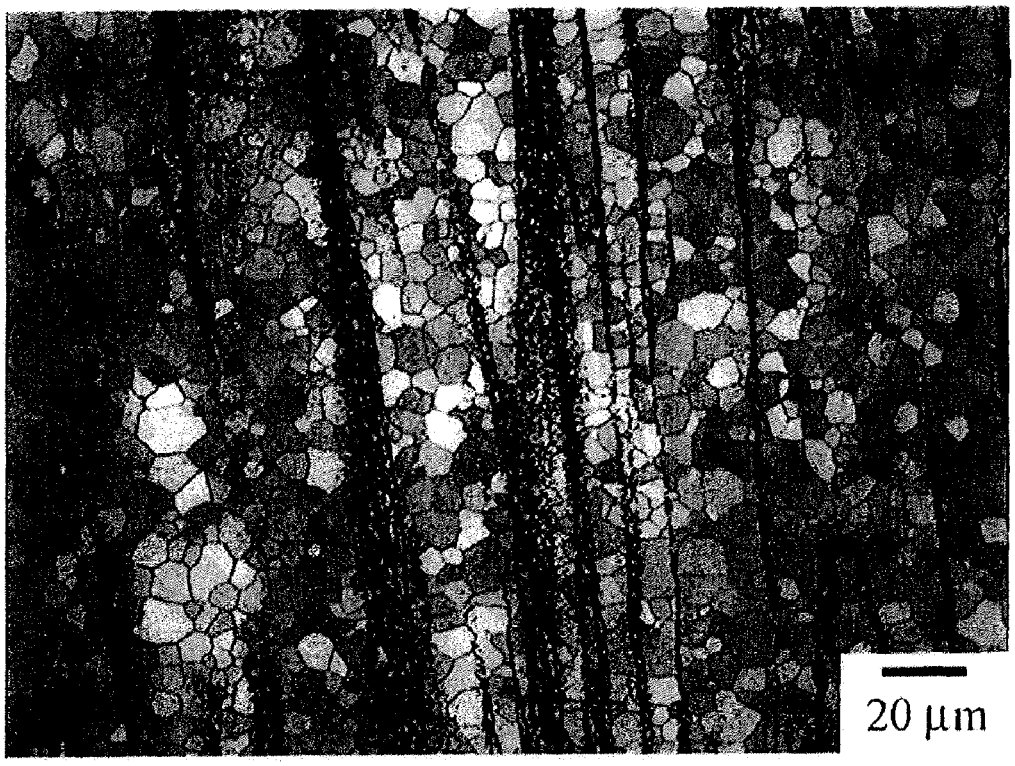
FIG. 4 is a photograph showing the result of microstructural observation in Example 1, and shows the result of microstructure of the extruded alloy by an optical microscope.
Figure 5:
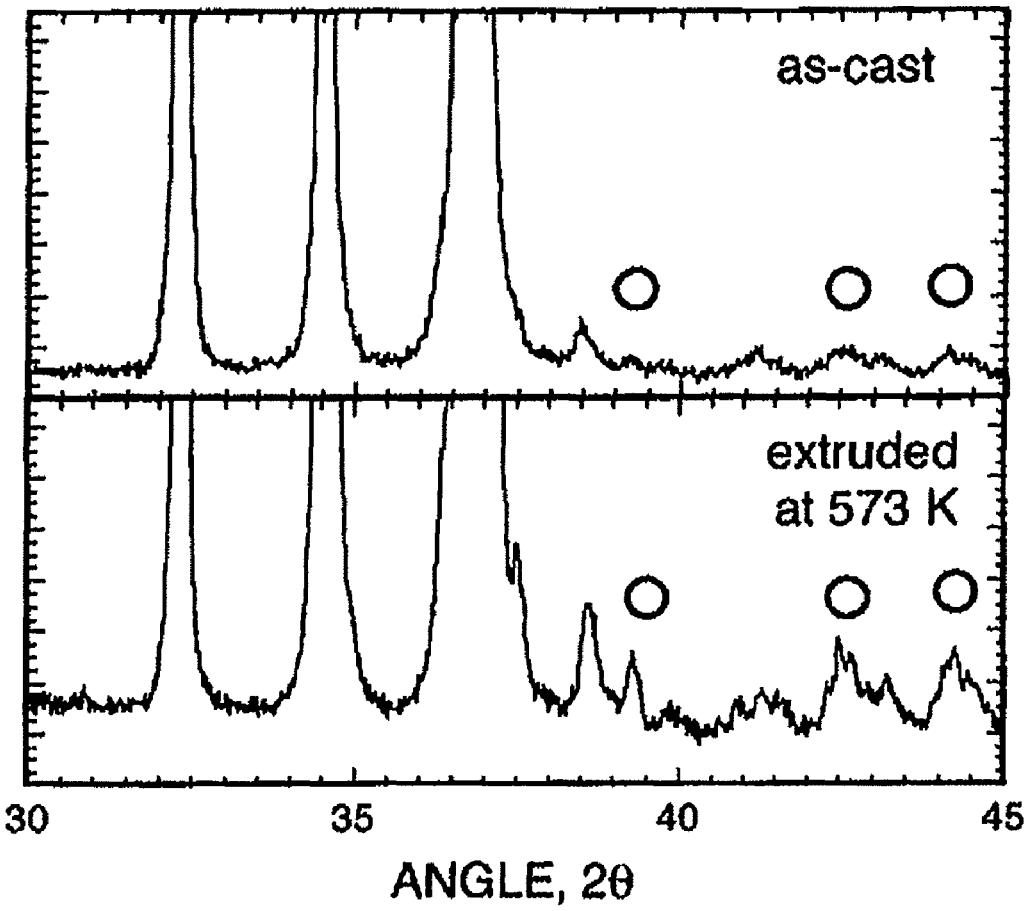
FIG. 5 shows the result of X-ray analysis in Example 1.

The results of the microstructural observation in the casted and extruded alloys were shown in FIG. 3 and FIG. 4. FIG. 5 shows the result of X-ray analysis of the two alloys. From FIG. 3, it is known that particles (P) with a size of a few microns exist in the magnesium matrix. From the selected area diffraction image, it is known that the particles (P) is a quasi-crystal phase. From FIG. 4, it is confirmed that the average size of the magnesium matrix in the extruded alloy is 12 μm. They are equi-axed grains and are quite homogeneous structures. The average size was measured by the linear intercept method. The X-ray diffraction patterns of the two samples, as shown in FIG. 5, are the same, and thus, the presence of the quasi-crystal phase in the magnesium matrix is confirmed after the extrusion process. The white circles in FIG. 5 are the diffraction angle of the quasi-crystal phase.

Figure 6:
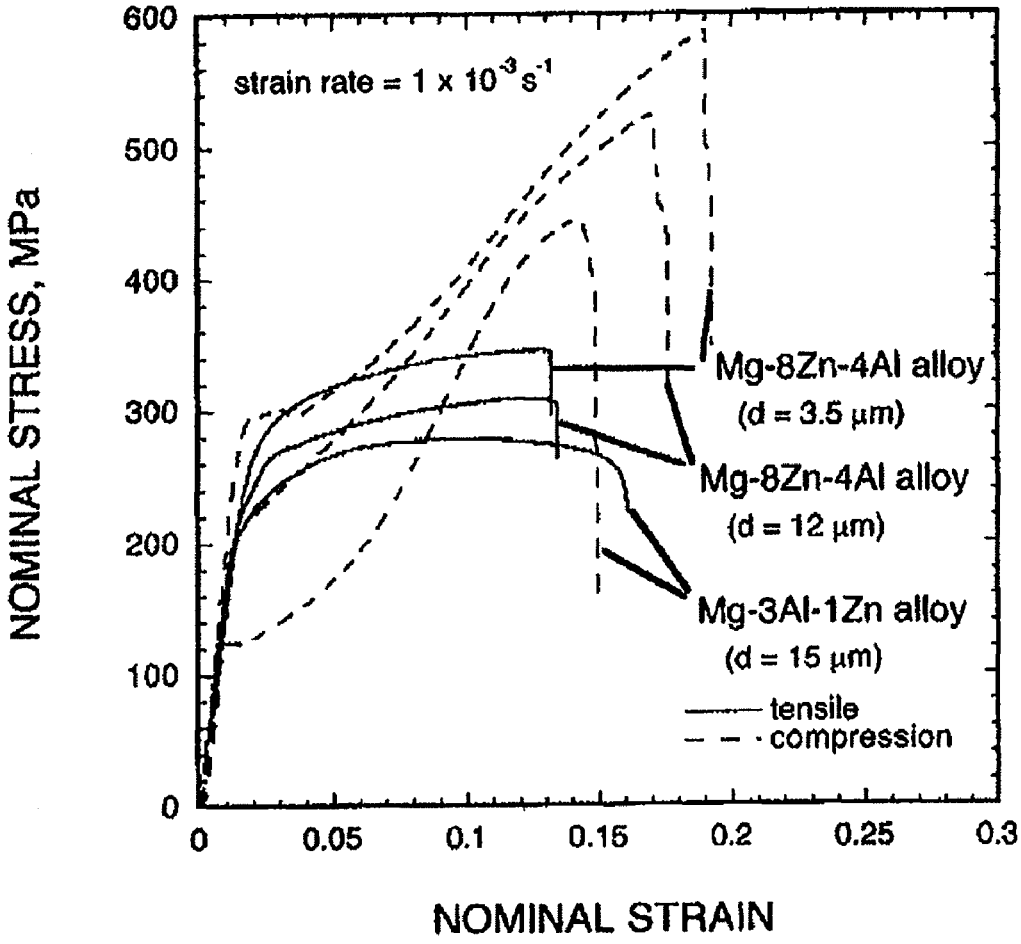
FIG. 6 is a nominal stress-nominal strain curves in tensile/compression test at room temperature in Examples 1 and 2 and Comparative Example 1.

A tensile test specimen has a diameter of 3 mm and a length of 15 mm and a compression test specimen has a diameter of 4 mm and a height of 8 mm. These specimens were machined from each material such as to make the tensile and compression axis parallel to the extrusion direction; and the initial tensile/compression strain rate was $1\times10^{-3}$ see. FIG. 6 shows a nominal stress-nominal strain curves in the tensile/compression test at room temperature. The results of the mechanical properties obtained from FIG. 6 are listed in Table 1. The yield stress is measured the stress value at a nominal strain 0.2%, the maximum tensile strength is measured the maximum nominal stress value, and the elongation is measured the nominal strain value when the nominal stress lowered by at least 30%.

Comparative Example 1

As a comparative example, the nominal stress-nominal strain curves of a typical wrought magnesium alloy, extruded Mg—3 wt. % Al—1 wt. % Zn (initial crystal particle size: about 15 μm) is also shown in FIG. 6. The two extruded alloys have nearly the same size of magnesium matrix; however, it is known that the yield stress in the tensile/compression of the extruded Mg—8 wt. % Zn—4 wt. % Al alloy is 228 and 210 MPa, respectively, and the Mg—8wt. % Zn—4wt. % Al alloy has excellent strength properties (especially, excellent compression strength property). The ratio of compression/tensile yield stress of the extruded Mg—8 wt. % Zn—4 wt. % Al alloy is 0.9, and thus, the Mg—8 wt. % Zn—4 wt. % Al alloy is found to have obvious reduction in the yield anisotropy.

Figure 9:
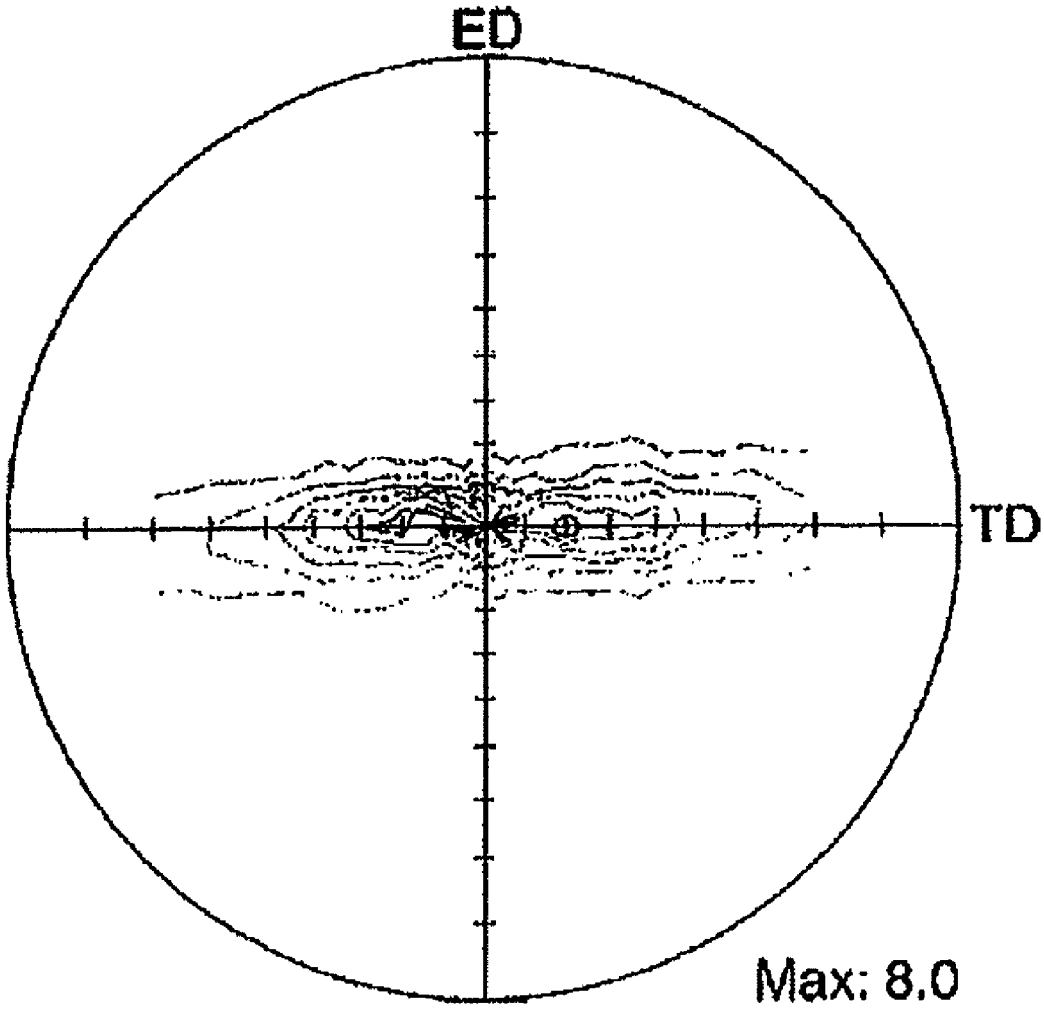
FIG. 9 shows the result of texture analysis by a Schulz reflection method in Comparative Example 1.

FIG. 9 shows the result of texture analysis by a Schulz reflection method of the extruded Mg—3 wt. % Al—1 wt. % Zn alloy of Comparative Example 1. It is known that the basal plane is lying to the extrusion direction, showing the typical texture of a extruded magnesium alloy. The maximum integration intensity is 8.0.

Example 2

Figure 7:
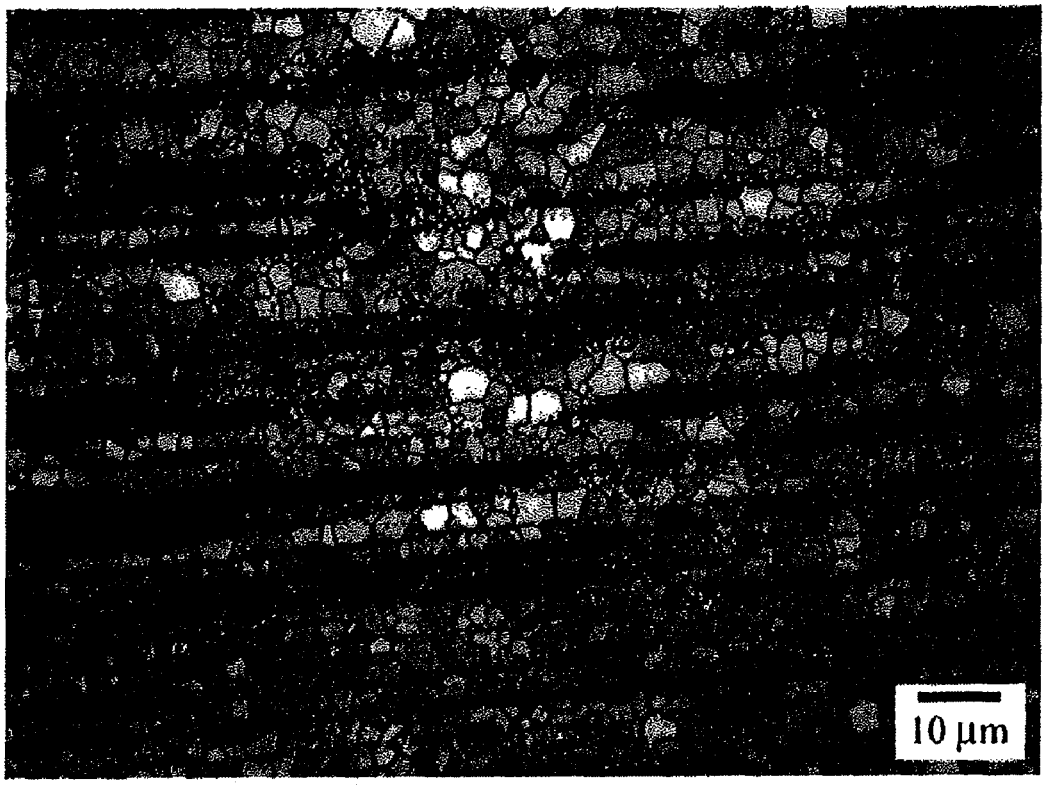
FIG. 7 is a photograph showing the result of microstructural observation in Example 2, and shows the result of microstructure of the extruded alloy by with an optical microscope.
Figure 8:
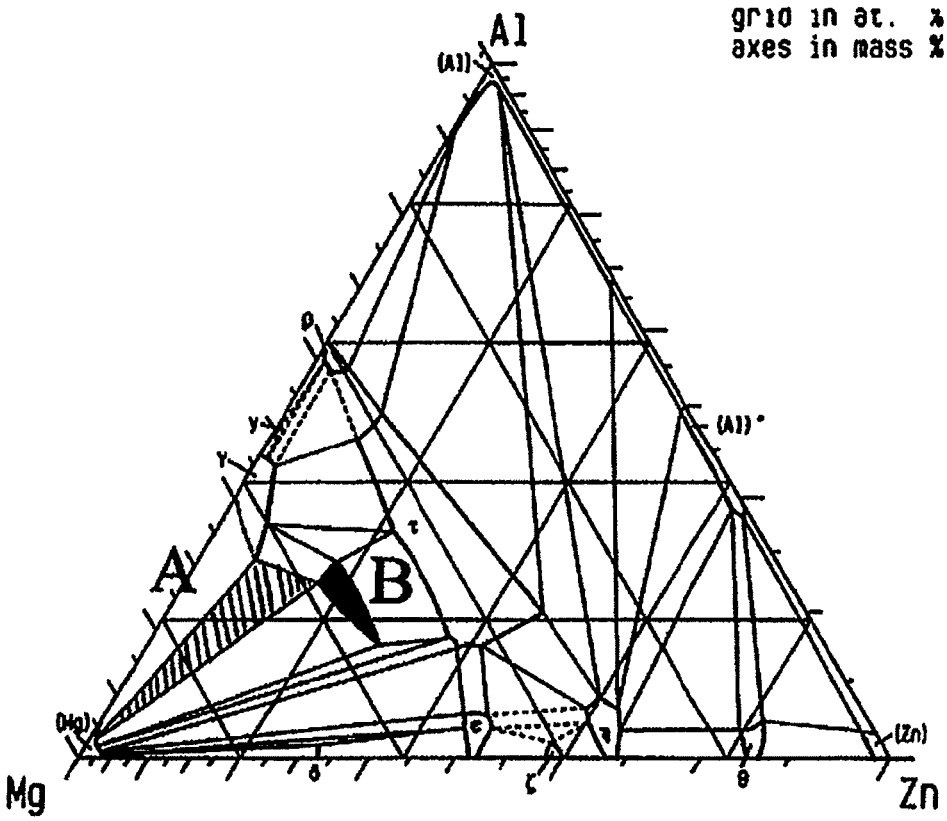
FIG. 8 is an Mg—Zn—Al ternary phase diagram.

Pure magnesium (purity, 99.95%), 8 wt. % zinc and 4 wt. % aluminum were melted to prepare a casted alloy. The casted alloy was machined to prepare an extrusion billet having a diameter of 40 mm. The extrusion billet was put into an extrusion container heated up to 200° C., kept therein for ½ hours, and then hot-extruded at an extrusion ratio of 25/1 to produce an extruded alloy having a diameter of 8 mm. The microstructural observation and the tensile/compression tests at room temperature were performed Under the same condition as in Example 1 described above. FIG. 7 shows the result of microstructural observation of the extruded alloy. FIG. 6 shows the nominal stress-nominal strain curves in tensile/compression tests at room temperature.

From FIG. 7, the average size of the Mg matrix was 3.5 μm. From FIG. 6, it is known that the yield stress in tensile and compression of the extruded alloy is 275 and 285 MPa, respectively. The strength is found to increase due to the grain refinement. The ratio of the compression/tensile yield stress is more than 1, which confirms the reduction of yield anisotropy of this extruded alloy.

Figure 10:
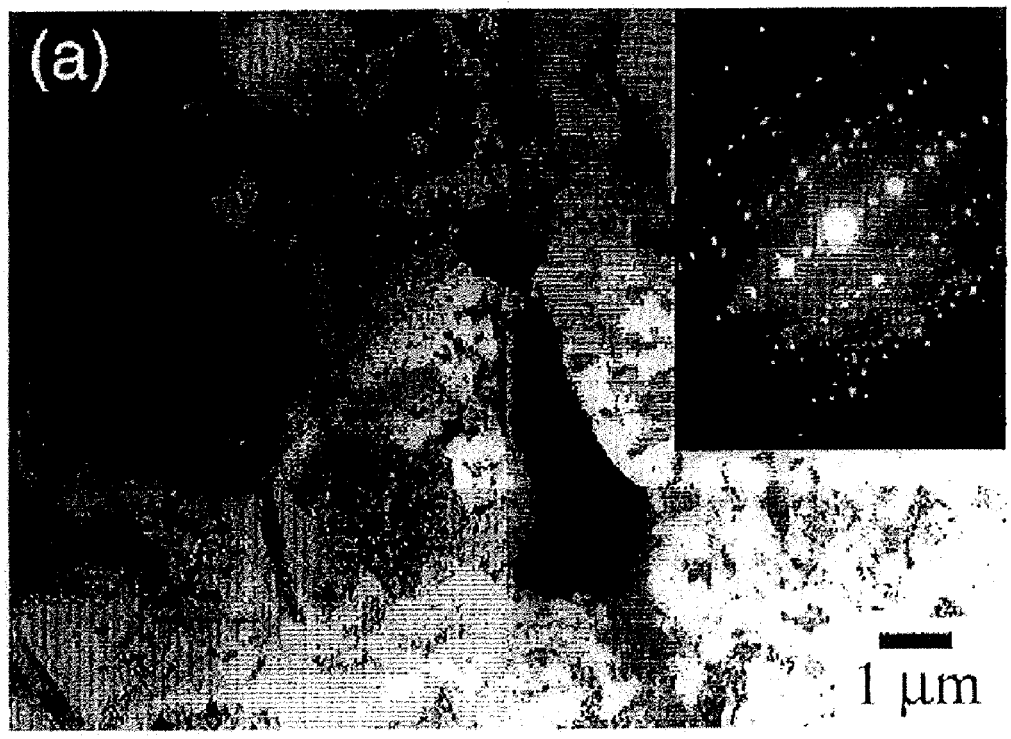
FIG. 10 shows an example of microstructural observation by a transmission electronic microscope in Example 2.

FIG. 10 shows the result of microstructural observation by a transmission electronic microscope of the extruded alloy of Example 2. The Mg matrix is confirmed to be fine as in FIG. 7. From the selected area diffraction image, it is known that the particles which exist in the matrix, are consisted of the quasi-crystal phase particles.

Figure 11:
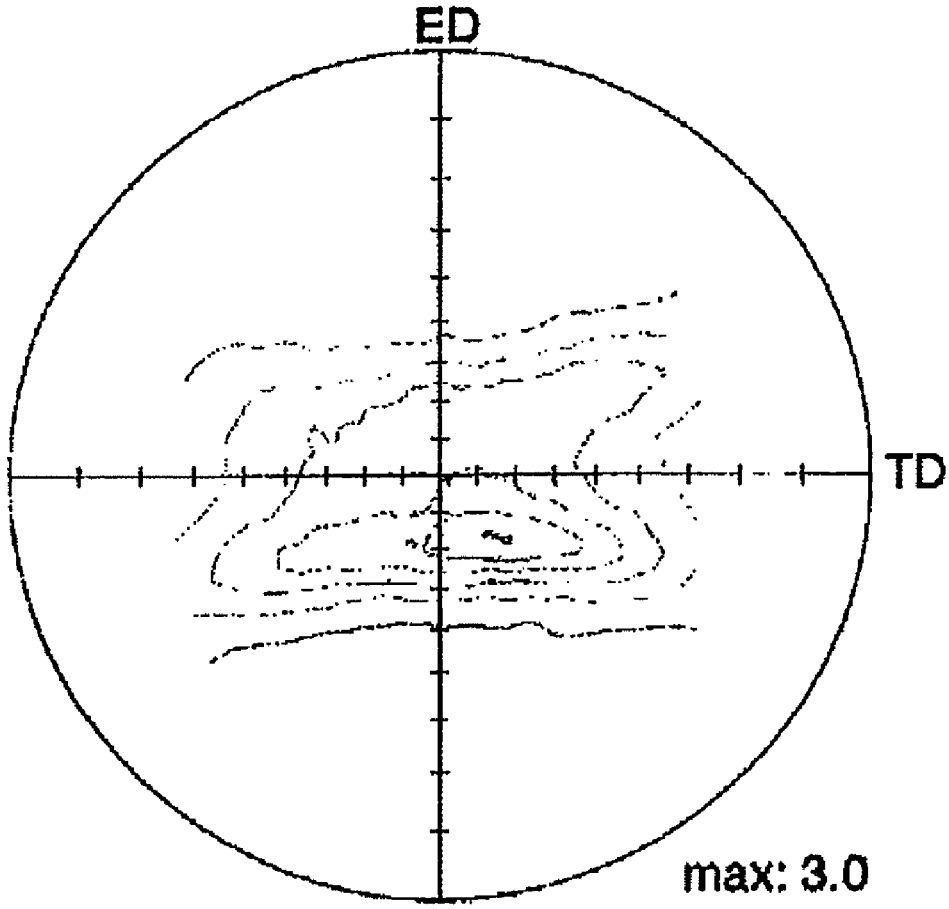
FIG. 11 shows the result of texture analysis by a Schulz reflection method in Example 2.

FIG. 11 shows the result of texture analysis by a Schulz reflection method of the extruded alloy of Example 2. It is confirmed that the basal plane tends to lies parallel to the extrusion direction as in FIG. 9. However, when the results of this alloy shown in FIG. 10 compares with that in FIG. 9, (i) the width of the texture in Example 2 is extremely broad, and (ii) the maximum integration intensity is not more than a half. It is considered that the reduction of strong yield anisotropy results from the broadening texture in basal plane and the reduction in the integration intensity shown in FIG. 11.

Examples 3 to 14

Figure 12:
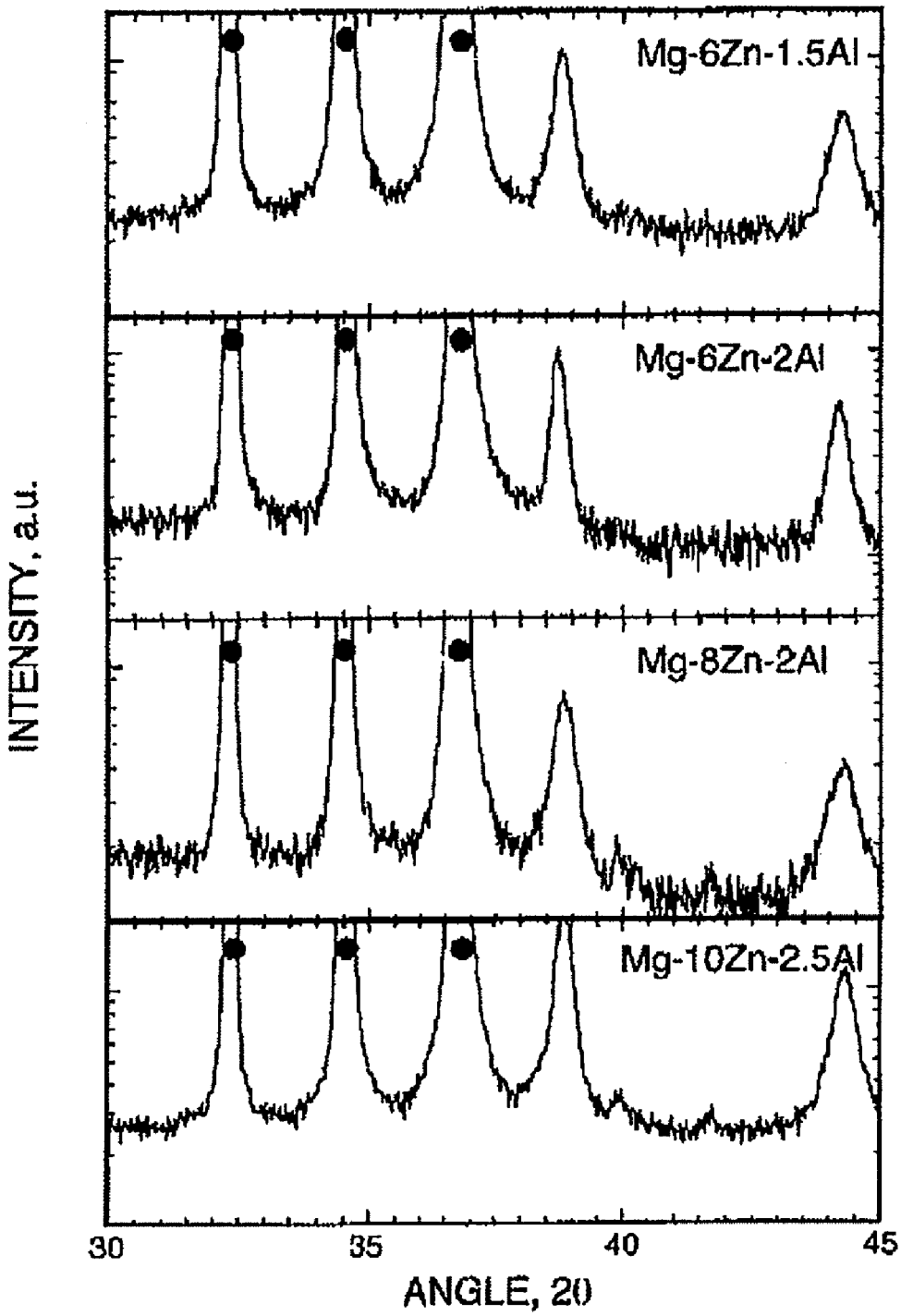
FIG. 12 shows a result of X-ray analysis in Examples 4, 5, 7 and 8.
Figure 13:
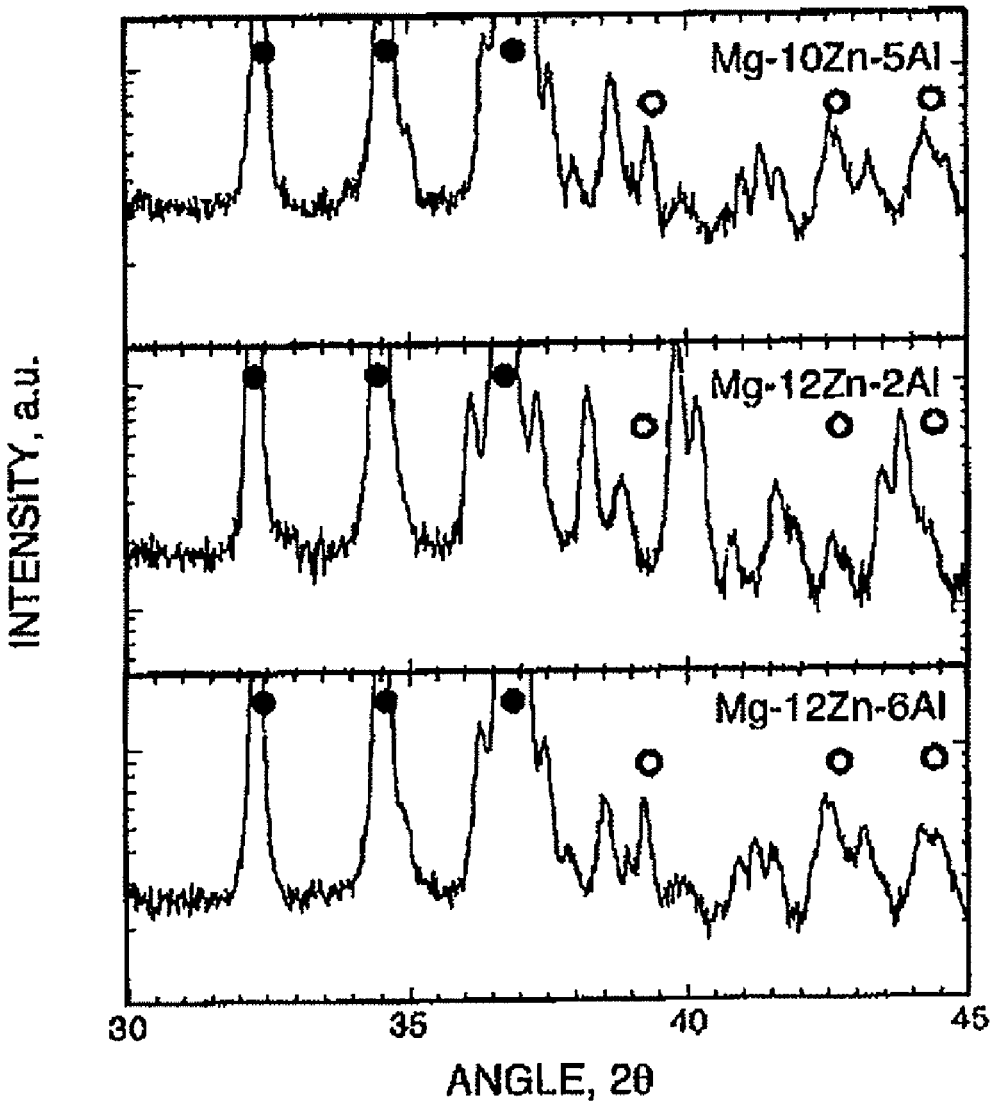
FIG. 13 shows a result of X-ray analysis in Examples 9, 10 and 12.

To add to the above-mentioned Examples 1 and 2 and Comparative Example 1, other samples were produced in the same procedures as above but changing the amount of Zn and Al elements. The mechanical properties were evaluated, and the results were listed in Table 1. The data in Table 1 obtained by the above-mentioned methods. FIG. 12 and FIG. 13 show the results of X-ray analysis in Examples 4, 5, 7 to 10 and 12. The black circles indicate magnesium and the white circles indicate the quasi-crystal phase; and the other diffraction peaks correspond to the close to the structure of quasi-crystal phase having components of Mg—Zn—Al.

In FIG. 12, the presence of a quasi-crystal phase is not confirmed, but the close to the structure of quasi-crystal phase is confirmed. The presence of a quasi-crystal phase and the close to the structure of quasi-crystal is confirmed in FIG. 13.

The alloys having a quasi-crystal phase or the close to the structure of quasi-phase show the reduction of yield anisotropy. On the other hand, it is known that the alloys having a quasi-crystal phase, i.e., Example 9 and 10, have a higher yield strength.

TABLE 1

| | | Zn/Al | σys, MPa | σUTS, MPa | δ, % | σcys, MPa | cys/tys | Quasi-Crystal | Quasi-Crystal Approximate Phase |
|---|---|---|---|---|---|---|---|---|---|
| Example 1 | ZA84 | 2 | 228 | 309 | 0.134 | 210 | 0.92 | ○ | ○ |
| Example 2 | ZA84 | 2 | 275 | 345 | 0.135 | 288 | 1.05 | ○ | ○ |
| Comparative Example 1 | AZ31 | 0.33 | 215 | 277 | 0.161 | 127 | 0.59 | X | X |
| Example 3 | ZA42 | 2 | 225 | 292 | 0.223 | 211 | 0.94 | X | ○ |
| Example 4 | ZA615 | 4 | 233 | 302 | 0.187 | 228 | 0.98 | X | ○ |
| Example 5 | ZA62 | 3 | 255 | 323 | 0.193 | 264 | 1.04 | X | ○ |
| Example 6 | ZA63 | 2 | 233 | 315 | 0.207 | 231 | 0.99 | ○ | ○ |
| Example 7 | ZA82 | 4 | 251 | 321 | 0.179 | 257 | 1.02 | X | ○ |
| Example 8 | ZA1025 | 4 | 255 | 329 | 0.102 | 279 | 1.10 | X | ○ |
| Example 9 | ZA105 | 2 | 264 | 344 | 0.096 | 296 | 1.12 | ○ | ○ |
| Example 10 | ZA122 | 6 | 268 | 337 | 0.096 | 282 | 1.05 | ○ | ○ |
| Example 11 | ZA124 | 3 | 290 | 356 | 0.110 | 319 | 1.10 | ○ | ○ |
| Example 12 | ZA126 | 2 | 305 | 329 | 0.071 | 352 | 1.15 | ○ | ○ |
| Example 13 | ZA164 | 4 | 301 | 362 | 0.066 | 334 | 1.11 | ○ | ○ |
| Example 14 | ZA202 | 10 | 330 | 383 | 0.043 | 378 | 1.15 | ○ | ○ |

σys: Tensile yield stress,
σUTS: Maximum tensile stress,
δ: Elongation,
σcys: Compression yield stress,
cys/tys: Ratio of compression/tensile yield stress.

In Table 1, ZA means a composition of Zn and Al (b wt. %, a wt. %); and in Examples 1 to 14, (b wt %, a wt %)=(8, 4), (8, 4), (4, 2), (6, 1.5), (6, 2), (6, 3), (8, 2), (10, 2.5), (10, 5), (12, 2), (12, 4), (12, 6), (16, 4), (20, 2).

The invention claimed is:

1. An Mg-base alloy containing Zn and Al added to magnesium, comprising a composition represented by (100-a-b) wt % Mg-a wt % Al-b wt % Zn and satisfying $0.5 \leqq b/a$; wherein quasi-crystal phase particles or their approximate crystal phase particles are dispersed in the magnesium matrix, the content of the quasi-crystal phase or the approximate crystal phase is from 1% to 40%, and the range of the particle size is from 50 nm to 5 μm.

2. The Mg-base alloy as claimed in claim 1, wherein the size of the Mg matrix is at most 40 μm.

3. The Mg-base alloy as claimed in claim 1, wherein the content of the quasi-crystal phase or the approximate crystal phase is from 2% to 30%.

4. The Mg-base alloy as claimed in claim 3, wherein the size of the Mg matrix is at most 40 μm.

5. The Mg-base alloy as claimed in claim 1, wherein $5 \leqq b \leqq 55$ and $2 \leqq a \leqq 18$.

6. The Mg-base alloy as claimed in claim 5, wherein the size of the Mg matrix is at most 40 μm.

7. The Mg-base alloy as claimed in claim 5, wherein the content of the quasi-crystal phase or the approximate crystal phase is from 2% to 30%.

8. The Mg-base alloy as claimed in claim 7, wherein the size of the Mg matrix is at most 40 μm.

* * * * *